US011353261B2

(12) United States Patent
Higginbotham et al.

(10) Patent No.: US 11,353,261 B2
(45) Date of Patent: Jun. 7, 2022

(54) LIGHTS REMOVAL FROM CARBON DIOXIDE

(71) Applicant: Air Products and Chemicals, Inc., Allentown, PA (US)

(72) Inventors: Paul Higginbotham, Surrey (GB); John Eugene Palamara, Macungie, PA (US); Cory E. Sanderson, Allentown, PA (US); John H. Petrik, Bethlehem, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 309 days.

(21) Appl. No.: 16/670,281

(22) Filed: Oct. 31, 2019

(65) Prior Publication Data

US 2021/0131727 A1 May 6, 2021

(51) Int. Cl.
*F25J 3/00* (2006.01)
*F25J 3/02* (2006.01)

(52) U.S. Cl.
CPC ..... *F25J 3/029* (2013.01); *F25J 3/0204* (2013.01); *F25J 2210/80* (2013.01); *F25J 2215/30* (2013.01)

(58) Field of Classification Search
CPC ..... F25J 3/00; F25J 3/02; F25J 3/0228; F25J 3/0266; F25J 3/066; F25J 3/028; F25J 3/029; F25J 2200/00; F25J 2200/02; F25J 2200/72; F25J 2200/74; F25J 2200/78; F25J 2205/02; F25J 2215/30; F25J 2215/80; F25J 2220/04; F25J 2245/00; F25J 2250/00; F25J 2250/30; F25J 3/04412; F25J 3/04787; F25J 3/04793; F25J 3/04884; F25J 5/005; C01B 32/50
See application file for complete search history.

(56) References Cited

U.S. PATENT DOCUMENTS

| | | | |
|---|---|---|---|
| 2,551,399 | A | 12/1945 | Silverberg |
| 3,355,902 | A | 12/1967 | Crawford et al. |
| 3,740,962 | A | 6/1973 | Fan |
| 3,850,593 | A | 11/1974 | Beaujean et al. |
| 4,152,129 | A | 5/1979 | Trentham et al. |
| 4,762,543 | A | 8/1988 | Pantermuehl et al. |
| 4,952,223 | A | 8/1990 | Kirshnamurthy et al. |
| 4,969,338 | A | 11/1990 | Kirshnamurthy et al. |
| 5,011,521 | A | 5/1991 | Gottier |

(Continued)

FOREIGN PATENT DOCUMENTS

DE 102008059011 5/2010

OTHER PUBLICATIONS

Luuk Buit, et al, "CO2EuroPipe study of the occurrence of free water in dense phase CO2 transport", Energy Procedia, 2010, pp. 1-7.

*Primary Examiner* — Jianying C Atkisson
*Assistant Examiner* — Erik Mendoza-Wilkenfel
(74) *Attorney, Agent, or Firm* — Jason M. Ploeger

(57) ABSTRACT

Light gases such as helium are extracted from a carbon dioxide-containing feed stream by distillation. Costly dehydration steps are avoided by pumping the liquid bottoms stream leaving the distillation column without vaporization so as to ensure that any water present in the feed remains in solution with the bulk stream leaving the process. This prevents any liquid phase water causing corrosion or solid ice or hydrates forming to plug the flow.

9 Claims, 2 Drawing Sheets

(56) References Cited

U.S. PATENT DOCUMENTS

| | | | | |
|---|---|---|---|---|
| 5,017,204 | A | 5/1991 | Gottier et al. | |
| 5,329,775 | A | 7/1994 | Fiedler et al. | |
| 5,927,103 | A | 7/1999 | Howard | |
| 5,956,971 | A * | 9/1999 | Cole | F25J 1/0022 62/623 |
| 5,974,829 | A | 11/1999 | Novak et al. | |
| 5,983,633 | A | 11/1999 | Woleslagle et al. | |
| 6,035,662 | A | 3/2000 | Howard et al. | |
| 6,070,431 | A | 6/2000 | Howard | |
| 6,301,927 | B1 | 10/2001 | Reddy | |
| 7,201,019 | B2 | 4/2007 | Howard | |
| 7,454,923 | B2 | 11/2008 | Howard | |
| 7,461,522 | B2 | 12/2008 | Howard | |
| 7,666,251 | B2 | 2/2010 | Shah et al. | |
| 8,216,351 | B2 | 7/2012 | Shah et al. | |
| 9,791,210 | B2 | 10/2017 | Higginbotham et al. | |
| 2008/0000265 | A1 * | 1/2008 | Cuellar | H04W 28/10 62/630 |
| 2011/0048067 | A1 * | 3/2011 | Fischer | F25J 3/0238 62/620 |
| 2012/0000243 | A1 * | 1/2012 | Bough | F25J 3/0266 62/617 |
| 2012/0186296 | A1 * | 7/2012 | Gnanendran | C10L 3/10 62/637 |
| 2016/0265842 | A1 | 9/2016 | Dray et al. | |

* cited by examiner

LIGHTS REMOVAL FROM CARBON DIOXIDE

BACKGROUND

The present invention provides systems and methods for obtaining helium-rich product fractions from feed streams containing carbon dioxide, as well as systems and methods for removing compounds with a lower boiling point than carbon dioxide from a bulk carbon dioxide stream.

There are many high-pressure gas fields that supply carbon dioxide-rich gas streams for the oil and gas industry. In general, the carbon dioxide ($CO_2$) content of these streams is greater than 50% by volume, or from about 60% to 98% by volume. Unless otherwise specified, all compositions will be presented on a volume basis. In addition, the gas mixture typically contains methane (for example, from about 0.1% to about 20%), nitrogen (from about 0.1% to about 30%), other hydrocarbons (up to about 5%) and small amounts of argon, hydrogen, and helium (up to about 1% for each). These CO2-rich gas streams have been used in the industry for enhanced oil recovery (EOR), and the associated hydrocarbons are optionally recovered when economically justified. In general, CO2-rich gas streams with a significant concentration of light gases (typically greater than about 5%) such as nitrogen, argon, oxygen, hydrogen, and helium, are less effective when used for EOR, justifying purification of the CO2 in many cases.

Helium is used in a variety of applications, including for example cryogenic processes, pressurizing and purging systems, maintaining controlled atmospheres, lifting, and welding. Since helium is becoming increasingly scarce, new ways to recover helium are being considered, including ways to recover small amounts of helium from CO2-rich streams. In order to do so, a crude helium stream must be recovered that has a sufficient composition and pressure for further treatment in a helium purification and liquefaction process. The recovered crude helium stream should have a helium content of at least about 35%, or at least about 50%, with the balance nitrogen, and only trace amounts of CO2.

Carbon dioxide has a critical temperature of 31° C. and a critical pressure of 73.8 bar (all pressures will be provided on an absolute, rather than gauge, basis). As a sample of carbon dioxide with liquid and vapor phases in equilibrium is heated and pressurized towards and then above the critical point of 31° C. and 73.8 bar, the boundary between liquid and vapor gradually becomes less distinct and then vanishes as the carbon dioxide becomes a single supercritical fluid phase, which acts as a dense, but compressible, fluid.

The critical point of carbon dioxide is near the operating conditions of most carbon dioxide-carrying pipelines. The operating pressure is typically above the critical pressure and the operating temperature may be above or below the critical temperature depending on the ambient conditions.

Howard U.S. Pat. No. 7,201,019 teaches a method of separating light compounds from a bulk carbon dioxide gas in which a liquid carbon dioxide-rich stream leaves the separation scheme and is vaporized in the heat exchange network to provide refrigeration.

Howard U.S. Pat. No. 5,927,103 teaches a method of removing light compounds from a bulk carbon dioxide feed by distillation wherein the feed is cooled by external refrigeration, with preferably ammonia as the refrigerant.

Shah et al. U.S. Pat. No. 7,666,251 teach a method of stripping light compounds from a bulk carbon dioxide stream in which refrigeration is provided by condensing carbon dioxide in the overhead, expanding it to produce a vapor, and recycling that stream to the feed. The carbon dioxide product is vaporized in a heat exchanger and compressed to product pressure.

Higginbotham et al. U.S. Pat. No. 9,791,210 teaches a method of recovering helium from a bulk carbon dioxide gas using distillation. The liquid carbon dioxide-rich stream leaving the distillation column may be divided into two or more streams which in turn may be pumped or expanded to an optimal pressure to boil in the heat exchanger to provide refrigeration in the most efficient manner possible.

The extraction of light gases from carbon dioxide requires refrigeration, which often is provided at least in part by decreasing the pressure of the liquid carbon dioxide-enriched stream and allowing it to vaporize. The recompression of the vaporized carbon dioxide-enriched stream is power intensive, and the cold vapor introduces a freezing risk if any condensable compounds, such as water vapor, are present. There exists a need for a more efficient process to remove light compounds from carbon dioxide that has an improved water tolerance.

SUMMARY

This invention relates to a multi-step process to extract light gases from a bulk carbon dioxide. First, contaminants are removed as needed, for example water and heavy hydrocarbons by temperature swing adsorption and/or mercury by adsorption on activated carbon. Next the light gases are extracted by distillation. If the light gases stream contains valuable co-products such as helium, it may be warmed and purified by any combination of one or more steps including membrane, adsorption, absorption, and/or distillation.

The carbon dioxide-rich liquid exits the bottom of the distillation column system and is pumped to an intermediate pressure, then warmed to recover refrigeration, and pumped again to the final pressure. The intermediate pressure is chosen such that the carbon dioxide-rich liquid will not vaporize in the heat exchanger while warming up. The final pressure is chosen to match the feed pressure if returning to a pipeline, or is chosen to match the pressure required for utilization, e.g. injection for EOR.

BRIEF DESCRIPTION OF THE DRAWINGS

The present invention will hereinafter be described in conjunction with the appended figures, wherein like numerals denote like elements.

DETAILED DESCRIPTION

Figure 1:
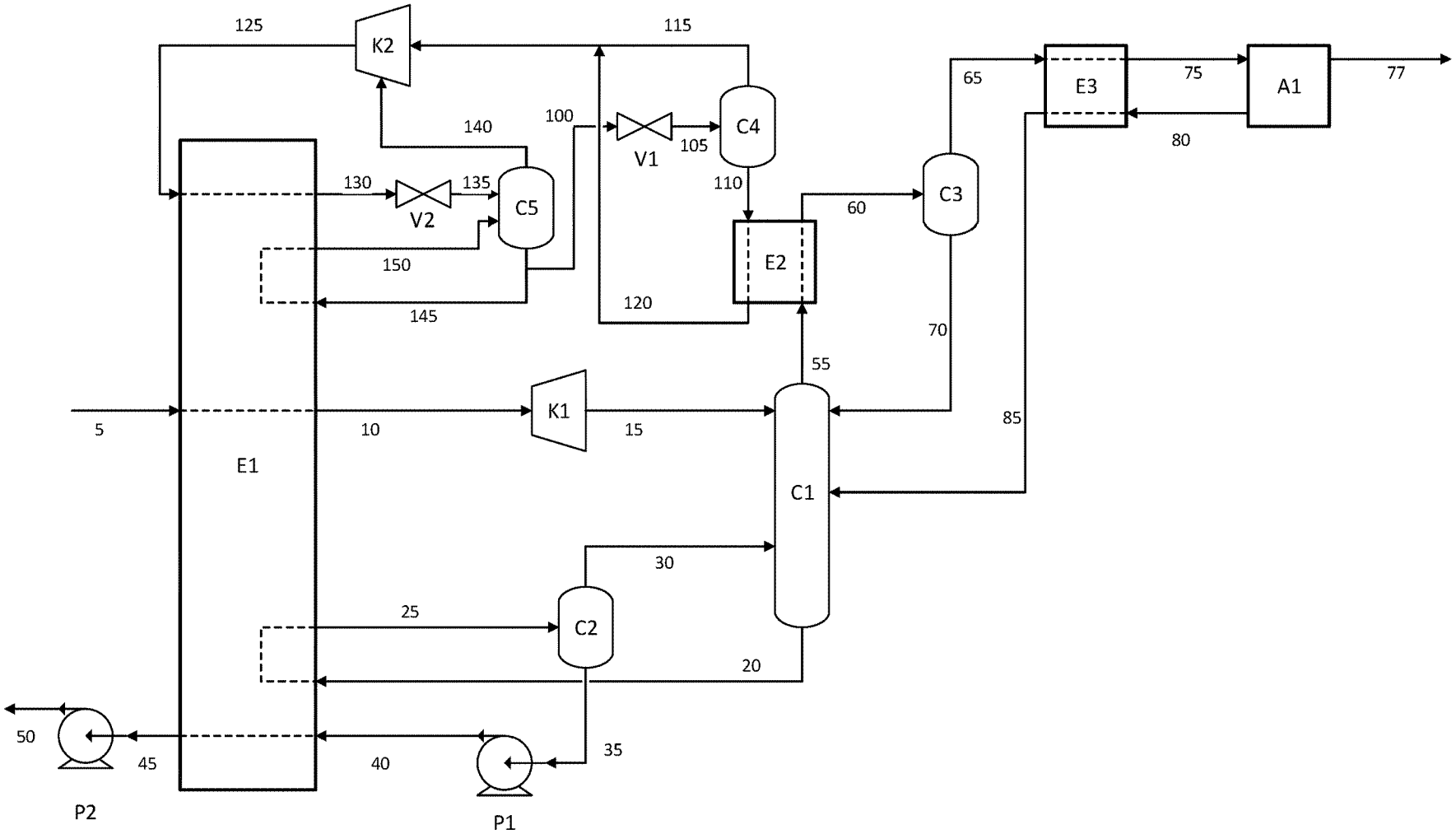
FIG. 1 is a flowsheet depicting the light gases extraction process according to the present invention.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing the preferred exemplary embodiments of the invention. Various changes may be made in the function and arrangement of elements without departing from the spirit and scope of the invention, as set forth in the appended claims.

The articles "a" or "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "and/or" placed between a first entity and a second entity includes any of the meanings of (1) only the first entity, (2) only the second entity, or (3) the first entity and the second entity. The term "and/or" placed between the last two entities of a list of 3 or more entities means at least one of the entities in the list including any specific combination of entities in this list. For example, "A, B and/or C" has the same meaning as "A and/or B and/or C" and comprises the following combinations of A, B and C: (1) only A, (2) only B, (3) only C, (4) A and B but not C, (5) A and C but not B, (6) B and C but not A, and (7) A and B and C.

The term "plurality" means "two or more than two."

The adjective "any" means one, some, or all, indiscriminately of quantity.

The phrase "at least a portion" means "a portion or all." The "at least a portion of a stream" has the same composition, with the same concentration of each of the species, as the stream from which it is derived.

As used herein, "first," "second," "third," etc. are used to distinguish among a plurality of steps and/or features, and is not indicative of the total number, or relative position in time and/or space, unless expressly stated as such.

All composition values will be specified in mole percent.

The terms "depleted" or "lean" mean having a lesser mole percent concentration of the indicated component than the original stream from which it was formed. "Depleted" and "lean" do not mean that the stream is completely lacking the indicated component.

The terms "rich" or "enriched" mean having a greater mole percent concentration of the indicated component than the original stream from which it was formed.

"Downstream" and "upstream" refer to the intended flow direction of the process fluid transferred. If the intended flow direction of the process fluid is from the first device to the second device, the second device is downstream of the first device. In case of a recycle stream, downstream and upstream refer to the first pass of the process fluid.

The term "dense fluid expander," abbreviated DFE, also known as a liquid expander, refers to equipment that extracts mechanical work from lowering the pressure of a dense fluid such as a liquid or a supercritical fluid, similar in function to an expander for gases. This expansion is best approximated as an isentropic process, as opposed to a valve which is best approximated as an isenthalpic process.

The term "indirect heat exchange" refers to the process of transferring sensible heat and/or latent heat between two or more fluids without the fluids in question coming into physical contact with one another. The heat may be transferred through the wall of a heat exchanger or with the use of an intermediate heat transfer fluid. The term "hot stream" refers to any stream that exits the heat exchanger at a lower temperature than it entered. Conversely, a "cold stream" is one that exits the heat exchanger at a higher temperature than it entered.

The term "distillation column" includes fractionating columns, rectifying columns, and stripping columns. "Distillation column" may refer to a single column or a plurality of columns in series or parallel, where the plurality can be any combination of the above column types. Each column may comprise one or more sections of trays and/or packing.

The term "reboiling" refers to partially vaporizing a liquid present in the distillation column, typically by indirect heat exchange against a warmer process stream. This produces a vapor that facilitates mass transfer within the distillation column. The liquid may originate in the bottoms liquid or an intermediate stage in the column. The heat duty for reboiling may be transferred in the distillation column using an in situ reboiler or externally in a heat exchanger dedicated for the purpose or part of a larger heat exchanger system. The vapor-liquid separation also may take place within the distillation column or within an external flash vessel.

The term "solubility safety factor" or "SSF" is defined as the ratio of the mole fraction of a condensable compound (such as water, mercury, or heavy hydrocarbons) that would form a separate liquid or solid phase in a given stream divided by the actual mole fraction of that condensable compound in the given stream.

The term "heavy hydrocarbons" refers to any hydrocarbon species that would freeze at the cold end of the process, which in the case of the present invention includes hydrocarbon molecules with six or more carbon atoms.

The present apparatus and process are described with reference to the figures. In this disclosure, a single reference number may be used to identify a process gas stream and the process gas transfer line that carries said process gas stream. Which feature the reference number refers to will be understood depending on the context.

For the purposes of simplicity and clarity, detailed descriptions of well-known devices, circuits, and methods are omitted so as not to obscure the description of the present invention with unnecessary detail.

The feed stream described in the present invention refers to a liquid or supercritical fluid comprising carbon dioxide, typically either originating underground in a geological formation or having been extracted from a waste gas stream for the purposes of carbon capture. The feed stream typically enters the process described herein at a pressure of 80 to 200 bar, or from 6 to 200 bar. All pressures referred to are absolute, not gauge.

The carbon dioxide content in the feed stream typically ranges from 95% to 99.5% or from 90% to 99.9%. All composition percentages referred to are in volume, or molar, basis, not weight basis.

The light gas content in the feed stream typically ranges from 1% to 5%, or from 0.1% to 10%. The light gases typically comprise nitrogen, methane, oxygen, helium, and/or hydrogen.

FIG. 1 shows the process for removal of light gases from carbon dioxide in detail.

Feed stream 5 is cooled in main heat exchanger E1 to produce a cooled feed stream 10. If the pressure of the feed stream is higher than the operating pressure of the distillation column C1, especially if the feed stream is above the critical pressure, then the cooled feed stream 10 may be expanded in expander K1 to form distillation column feed stream 15. In cases where the feed stream is above the critical pressure, the expander K1 is most likely to be a dense fluid expander (DFE).

The distillation column requires a reboiler, which is shown in FIG. 1 as an external reboiler. In this configuration first liquid stream 20 leaves the bottom of the distillation column C1 and then is heated indirectly by the feed gas in main heat exchanger E1. The partially vaporized stream 25 is then separated in reboiler separator C2. The distillation column C1, the reboiler separator C2, and the portion of main heat exchanger E1 used for transferring heat from stream 5 to stream 20 comprise the distillation column system. Vapor stream 30 is returned to the distillation column C1 and the lights-depleted bottoms liquid 35 exits the distillation column system.

The distillation column system is shown in FIG. 1 with an external reboiler arrangement, where C2 is the reboiler separator. The reboiler can also be internal to the column. An external reboiler can be a separate heat exchanger or integrated into a multiple-stream heat exchanger with other hot and cold streams as shown as E1 in FIG. 1. The reboiler provides vapor feed to the bottom of the column by boiling part of the liquid leaving the bottom of the column as first liquid stream 20. As known in the art, this can be done in several ways. A reboiler, such as a thermosyphon reboiler, could sit in the liquid sump to boil liquid within the sump. In that case a stream with a temperature between that of streams 5 and 10 would be fed to the reboiler to provide the required heat and the liquid stream leaving the column sump would have the same conditions as stream 35 in FIG. 1. The distillation column system can employ a reboiler described above or any other known reboiler.

The lights-depleted bottoms liquid 35 is then pumped in first pump P1 to a high enough pressure to prevent vaporization as the resulting pumped lights-depleted stream 40 is reheated in main heat exchanger E1. The resulting warmed lights-depleted stream 45, having avoided vaporization in E1, may then be pumped in second pump P2 to produce a lights-depleted return stream 50 that may be returned to the customer, for example into a pipeline for transmission.

Typically, lights-depleted bottoms liquid 35 would be vaporized in a heat exchanger to provide refrigeration and reduce overall compression costs. However, the present invention replaces a compressor with second pump P2, which returns the bottoms stream to elevated pressure with a higher efficiency and has the net effect of a compression cost saving.

Another benefit that results from not vaporizing the lights-depleted bottoms liquid 35 is the elimination of the risk of having a condensable compound drop out of solution—this can take the form of forming a separate liquid or solid phase, or a solid clathrate such as a water-carbon dioxide hydrate. These species, such as water, mercury, or heavy hydrocarbons, typically have a lower solubility in the vapor phase compared to the liquid or supercritical phase. Maintaining the lights-depleted bottoms liquid 35 as a liquid safely carries the condensable compounds out of the warm end of the system.

Buit et al.'s 2010 paper in Energy Procedia titled "CO2EuroPipe study of the occurrence of free water in dense phase CO2 transport" (vol. 4, pp. 3056-3062) provides a valuable illustration of water solubility in carbon dioxide. As liquid carbon dioxide vaporizes, the water solubility reaches a minimum near the phase transition point. The solubility safety factor would therefore be lower in any process that vaporized a water-containing stream than one with no vaporisation.

Lights-enriched vapor stream 55 exits the top of the distillation column C1 and may be partially condensed in condenser E2. The cooled lights-enriched stream 60 is then separated in condenser separator C3 to produce a crude lights stream 65 and a condensed stream 70. The condensed stream 70 is returned to the distillation column C1.

In FIG. 1, condenser E2 is shown in an external condenser arrangement. E2 could also be integrated with a multiple stream heat exchanger like main heat exchanger E1. The condenser E2 could also be internal to the distillation column C1.

The crude lights stream 65 may require purification, for example when the crude lights stream comprises helium in economically viable quantities. In this case the crude lights stream may be heated indirectly in crude heat exchanger E3 to produce a warmed crude lights stream 75, which in turn may then enter a purification system A1 to generate a pure lights product 77. The purification system A1 may utilize any combination of one or more steps including adsorption, absorption, membranes, and distillation, but in the current example it is a pressure swing adsorption unit. The byproduct from the purification system A1 will typically still contain light components that justify recovery, so the byproduct may be returned as recycle stream 80, which is cooled indirectly in crude heat exchanger E3 by the crude lights stream 65. If the byproduct leaves A1 at a lower pressure than C1, it will require compression before entering E3. The resulting cooled recycle stream 85 is fed to the distillation column C1.

The refrigeration required for this process is provided in part by the expansion of the feed gas, with the remaining duty provided by an external refrigeration cycle. In this example, the working fluid for the external refrigeration cycle is carbon dioxide, but any pure compound or mixture that has a convenient boiling point range can be used. First refrigerant liquid stream 100 is let down in pressure across first valve V1 and partially vaporized as first expanded refrigerant stream 105. First expanded refrigerant stream 105 is then separated in first flash vessel C4 to produce a second refrigerant liquid stream 110 and a first refrigerant vapor stream 115. Second refrigerant liquid stream 110 is at least partially vaporized in the condenser E2 to provide the refrigeration needed to partially condense lights-enriched vapor stream 55. The resulting first warmed refrigerant stream 120 is then mixed with first refrigerant vapor stream 115 and compressed in compressor K2 to produce compressed refrigerant vapor stream 125. Compressed refrigerant vapor stream 125 must be cooled and at least partially condensed. In FIG. 1 this is accomplished in main heat exchanger E1 to produce cooled compressed refrigerant stream 130, but it could also be accomplished in a separate heat exchanger against cooling water. Stream 130 is then expanded across second valve V2 to produce stream 135. Stream 135 is separated in second flash vessel C5 to form second refrigerant vapor stream 140, which is fed to an interstage of compressor K2, and first refrigerant liquid stream 100. A portion of the first refrigerant liquid stream 100 may be diverted as third refrigerant liquid stream 145 which is at least partially vaporized in main heat exchanger E1 to provide additional refrigeration. The resulting second warmed refrigerant stream 150 can then be returned to the second flash vessel C5, although if it has been entirely vaporized, it may instead feed K2 at an interstage. There may be cases in which streams 115, 120, and/or 140 may be at a low enough temperature to justify using them for refrigeration in E1. Here there is a tradeoff between including them in E1 to reduce overall power consumption and excluding them to simplify heat exchanger design or reduce operating risk.

Main heat exchanger E1, condenser E2, and crude heat exchanger E3 represent a heat exchanger system that can be a single heat exchanger or be split into two or more heat exchangers in series or parallel. For example, the main heat exchanger E1 may be divided into three separate heat exchangers. In the first heat exchanger, feed stream 5 and compressed refrigerant vapor stream 125 would be cooled against pumped lights-depleted stream 40. In the second heat exchanger, feed stream 5 would be further cooled against first liquid stream 20, which would effectively form a separate reboiler heat exchanger that would simplify operation of the distillation column system. In the third heat exchanger, feed stream 5 would be subcooled against third refrigerant liquid stream 145. In general, the more integrated the heat exchanger system is, the more efficient the heat exchange is between all of the desired streams. However, the heat exchanger is often divided, which sacrifices efficiency, because the resulting small increase in overall power allows an advantage such as simplified operation, a smaller heat exchanger system, a simpler design of the heat exchanger system, or the reduction of risk to the process.

Figure 2:
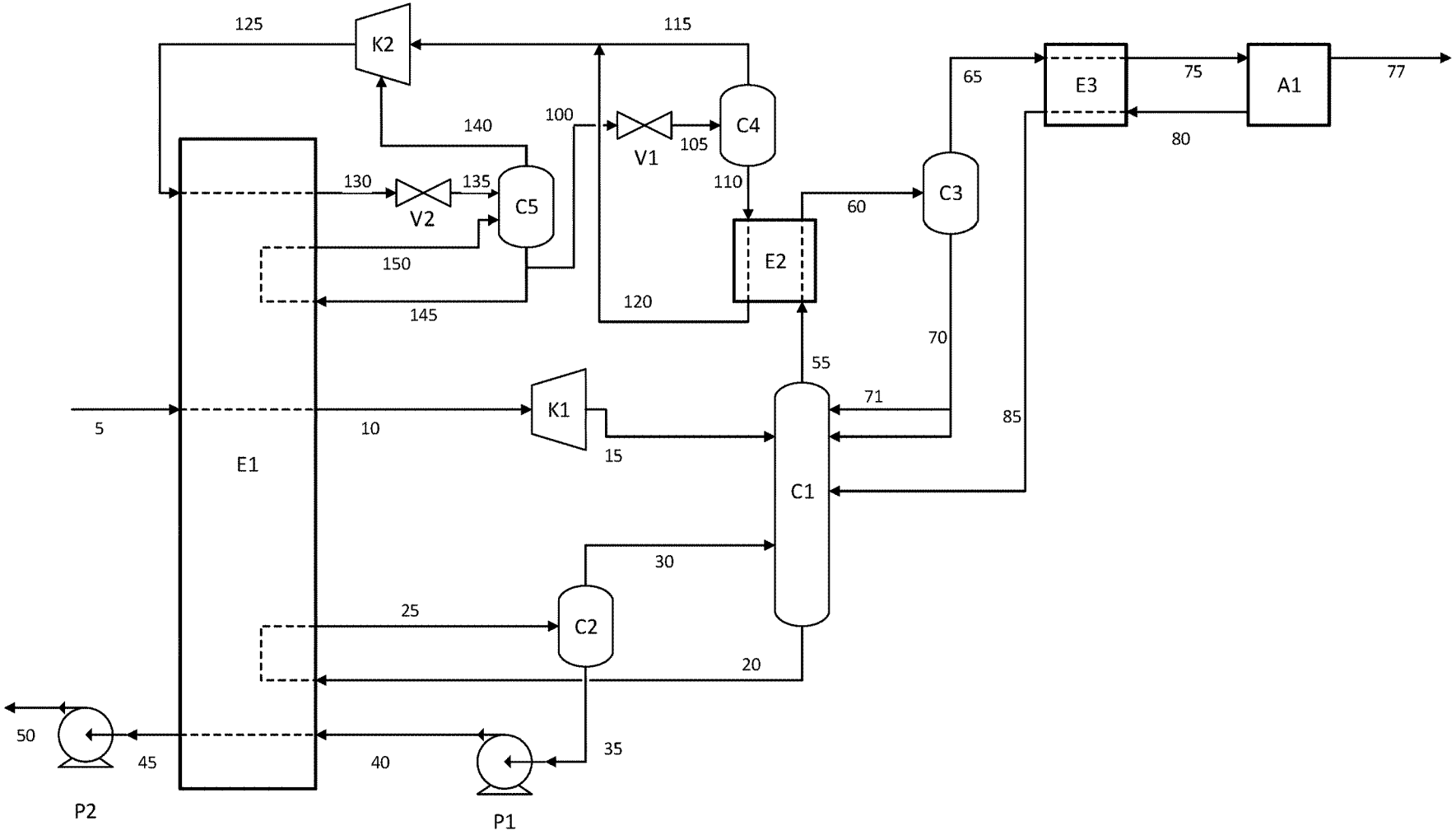
FIG. 2 is a flowsheet depicting a modification of the embodiment in FIG. 1 in which a portion of the condensed stream is used as a liquid wash stream to contact the vapor rising from the feed stage of the distillation column.

As shown in FIG. 2, if desired to improve the separation in distillation column C1, at least a portion of condensed stream 70 may be fed to the column at a higher location than that of distillation column feed stream 15 as liquid wash stream 71, so that it may contact over the span of one or more stages with the vapor phase rising from the feed stage location of distillation column feed stream 15.

Aspects of the present invention include:

#1: A process for recovering a light gas from a feed stream comprising carbon dioxide and at least one light gas selected from the group consisting of helium, methane, nitrogen, argon, and oxygen, said process comprising:

cooling said feed stream to form a distillation column feed stream;

separating said distillation column feed stream in a distillation column system to produce a lights-enriched vapor and a lights-depleted bottoms liquid;

pumping said lights-depleted bottoms liquid to produce a pumped lights-depleted stream;

and heating said pumped lights-depleted stream without vaporizing to produce a warmed lights-depleted stream.

#2: A process according to #1 further comprising the steps of:

cooling and at least partially condensing the lights-enriched vapor stream;

separating the cooled lights-enriched stream in a condenser separator to produce a crude lights stream and a condensed stream;

and feeding said condensed stream to said distillation column system.

#3: A process according to #2 further comprising the steps of:

warming the crude lights stream by indirect heat exchange with a recycle stream, producing a warmed crude lights stream and a cooled recycle stream;

and feeding said cooled recycle stream to said distillation column system.

#4: A process according to any of #2 to #3 wherein at least a portion of said condensed stream enters the distillation column at a higher stage than the stage at which the distillation column feed stream enters the distillation column.

#5: A process according to any of #1 to #4 wherein the feed stream is in the liquid phase and below the critical pressure.

#6: A process according to any of #1 to #4 wherein the feed stream is above the critical pressure.

#7: A process according to any of #1 to #6 further comprising the step of pumping said warmed lights-depleted stream to produce a lights-depleted return stream.

#8: A process according to #7 wherein the feed stream comprises a condensable compound selected from the group consisting of water, mercury, and heavy hydrocarbons.

#9: A process according to #8 wherein the lowest minimum solubility safety factor for condensable compounds among the lights-depleted bottoms liquid, the pumped lights-depleted stream, the section of the main heat exchanger in which the pumped lights-depleted stream is heated to form the warmed lights-depleted stream, the warmed lights-depleted stream, and the lights-depleted return stream is greater than the lowest minimum solubility safety factor for condensable compounds among the distillation column feed stream, the lights-enriched vapor stream, the cooled lights-enriched stream, and the distillation column system.

#10: A process according to any of #1 to #9 wherein the refrigeration duty for cooling and/or condensing at least one stream is provided by external refrigeration.

#11: A process according to #10 wherein the working fluid for the external refrigeration comprises carbon dioxide.

#12: A process according to any of #1 to #11 wherein the feed stream is expanded after cooling and prior to separation in said distillation column system.

#13: An apparatus for carrying out the process of any of #1 to #12, said apparatus comprising:

said distillation column system for separating said distillation column feed stream to produce said lights-enriched vapor and said lights-depleted bottoms liquid;

a pumping system in fluid flow communication with said distillation column system for pumping said lights-depleted bottoms liquid to produce said pumped lights-depleted stream;

and a first heat exchanger system in fluid flow communication with said distillation column system and said pumping system for cooling said feed stream to produce said distillation column feed stream by indirect heat exchange against said pumped lights-depleted stream without vaporizing to produce said warmed lights-depleted stream.

#14: An apparatus according to #13 further comprising:

a second heat exchanger system in fluid flow communication with said distillation column system for the cooling and at least partial condensation of said lights-enriched vapor;

and a condenser separator in fluid flow communication with said second heat exchanger system and said distillation column system for the separation of said cooled lights-enriched stream to produce a crude lights stream and a condensed stream.

#15: An apparatus according to #14 further comprising:

a purification system for separating said crude lights stream to produce a pure lights product and a recycle stream;

and a third heat exchanger system in fluid flow communication with said condenser separator and said purification system for the heating of said crude lights stream by indirect heat exchange against said recycle stream.

Example 1

A computer simulation of the process of FIG. 1 was carried out in Aspen Plus, a commercial process simulation software package available from Aspen Technology, Inc. The feed stream, entering above the critical pressure, contains 96.5% carbon dioxide, 3% nitrogen, 0.34% methane, 0.1% helium, and 600 ppmv water. Key stream parameters such as composition, pressure, temperature, and flow rate are shown in Table 1 along with total power consumption. Overall helium recovery in the process is 99.9%.

TABLE 1

| Stream | 5 | 10 | 15 | 35 | 40 | 45 |
|---|---|---|---|---|---|---|
| Temperature (C.) | 40.0 | 17.7 | 12.5 | 19.6 | 22.7 | 30.1 |
| Pressure (bar) | 120.0 | 120.0 | 70.0 | 70.0 | 85.0 | 85.0 |
| Molar Flow (kmol/s) | 4.167 | 4.167 | 4.167 | 4.163 | 4.163 | 4.163 |
| Vapor Fraction | | | 0.00 | 0.00 | | |
| Mole fraction CO2 | 0.9650 | 0.9650 | 0.9650 | 0.9660 | 0.9660 | 0.9660 |
| Mole fraction N2 | 0.0300 | 0.0300 | 0.0300 | 0.0300 | 0.0300 | 0.0300 |
| Mole fraction CH4 | 0.0034 | 0.0034 | 0.0034 | 0.0034 | 0.0034 | 0.0034 |
| Mole fraction He | 0.0010 | 0.0010 | 0.0010 | 0.0000 | 0.0000 | 0.0000 |
| Water content (ppmv) | 600 | 600 | 600 | 601 | 601 | 601 |

| Stream | 50 | 55 | 60 | 65 | 70 |
|---|---|---|---|---|---|
| Temperature (C.) | 41.5 | 11.7 | −26.0 | −26.0 | −26.0 |
| Pressure (bar) | 120.0 | 70.0 | 70.0 | 70.0 | 70.0 |
| Molar Flow (kmol/s) | 4.163 | 0.416 | 0.416 | 0.084 | 0.333 |
| Vapor Fraction | | 1.00 | 0.20 | 1.00 | 0.00 |
| Mole fraction CO2 | 0.9660 | 0.7955 | 0.7955 | 0.3560 | 0.9061 |
| Mole fraction N2 | 0.0300 | 0.1772 | 0.1772 | 0.5468 | 0.0842 |
| Mole fraction CH4 | 0.0034 | 0.0114 | 0.0114 | 0.0262 | 0.0076 |
| Mole fraction He | 0.0000 | 0.0158 | 0.0158 | 0.0710 | 0.0019 |
| Water content (ppmv) | 601 | 157 | 157 | 9 | 194 |
| K1 (kW) | −759 | | | | |
| K2 (kW) | 1752 | | | | |
| P1 (kW) | 528 | | | | |
| P2 (kW) | 1542 | | | | |
| Total power (kW) | 3064 | | | | |

The water content of the feed stream is slightly lower than the typical pipeline specification in the United States of about 630 ppmv (30 lb/MMSCF). The maximum water solubility for a vapor stream of this composition would occur at just below the mixture critical pressure of 79.5 bar, with a value of about 2000 ppmv. If warmed lights-depleted stream 45 were vaporized, the best-case (maximum) solubility safety factor (SSF) would be 3.3 (2000 ppmv/600 ppmv), but in the present example the desired SSF for plant operability is at least 4. Therefore, the inventors have found that vaporizing any water-containing stream, such as the feed to the column or the bottoms stream from the column, is to be avoided to eliminate the risk of free water forming and the subsequent corrosion damage of free liquid phase water in the presense of an acidic species like carbon dioxide.

A key feature of the process modeled for Example 1 is that condensed stream 70 enters the column on the same stage as distillation column feed stream 15. In effect there are no stages devoted to washing the vapor rising through the column, and therefore there is still a significant amount of water in the lights-enriched vapor stream 55. In order to maintain a minimum SSF value of 4, the temperature of the condenser E2 is limited to −26° C. When compared to using a wash section, the present example yields lower overall power at the cost of producing a crude lights stream with lower helium mole fraction.

When a supercritical carbon dioxide stream is heated, the solubility of water passes through a minimum (or a point of inflection) when the stream reaches a density lower than the critical density, about 470 kg/m$^3$ in the example. For this reason the pressure of lights-depleted bottoms liquid 35 is increased to 85 bar in pump P1. This high pressure of pumped lights-depleted stream 40 keeps the stream from approaching the critical density in main heat exchanger E1. The SSF of streams 40 and 45 are both maintained above 4 and 5, respectively. In Example 1 the minimum SSF of 4 occurs in the distillation column feed stream 15 and in the condenser E2 rather than streams 40 or 45. Contrast this with Shah, where the equivalent of the present invention's lights-depleted bottoms liquid stream is vaporized and the minimum SSF would occur in the equivalent of stream 40 as it is heated in the equivalent of E1 at a value of less than 3.3.

A person of ordinary skill in the art would mitigate the risk of freezing in a process such as Shah by removing water below the 600 ppmv in the present example. Triethylene glycol (TEG) is a poor solvent for dehydration in supercritical carbon dioxide, as TEG has a high solubility in supercritical carbon dioxide. Glycerol has a lower solubility in supercritical carbon dioxide but is a less efficient solvent for dehydration. Temperature swing adsorption may be used, but at great capital and operating cost for dense phase supercritical fluid. The present invention avoids such difficult and costly dehydration.

Example 2

A computer simulation of the process of FIG. 2 was carried out using Aspen Plus. As in Example 1, the feed stream, entering above the critical pressure, contains 96.5% carbon dioxide, 3% nitrogen, 0.34% methane, 0.1% helium, and 600 ppmv water. Key stream parameters such as composition, pressure, temperature, and flow rate are shown in Table 2 along with total power consumption.

TABLE 2

| Stream | 5 | 10 | 15 | 35 | 40 | 45 |
|---|---|---|---|---|---|---|
| Temperature (C.) | 40.0 | 17.7 | 12.5 | 19.6 | 22.7 | 30.1 |
| Pressure (bar) | 120.0 | 120.0 | 70.0 | 70.0 | 85.0 | 85.0 |

TABLE 2-continued

| | | | | | | |
|---|---|---|---|---|---|---|
| Molar Flow (kmol/s) | 4.167 | 4.167 | 4.167 | 4.163 | 4.163 | 4.163 |
| Vapor Fraction | | | 0.00 | 0.00 | | |
| Mole fraction CO2 | 0.9650 | 0.9650 | 0.9650 | 0.9660 | 0.9660 | 0.9660 |
| Mole fraction N2 | 0.0300 | 0.0300 | 0.0300 | 0.0300 | 0.0300 | 0.0300 |
| Mole fraction CH4 | 0.0034 | 0.0034 | 0.0034 | 0.0034 | 0.0034 | 0.0034 |
| Mole fraction He | 0.0010 | 0.0010 | 0.0010 | 0.0000 | 0.0000 | 0.0000 |
| Water content (ppmv) | 600 | 600 | 600 | 601 | 601 | 601 |
| Stream | 50 | 55 | 60 | 65 | 70 | 71 |
| Temperature (C.) | 41.4 | 8.9 | −50.0 | −50.0 | −50.0 | −50.0 |
| Pressure (bar) | 120.0 | 70.0 | 70.0 | 70.0 | 70.0 | 70.0 |
| Molar Flow (kmol/s) | 4.163 | 0.343 | 0.343 | 0.066 | 0.276 | 0.083 |
| Vapor Fraction | | 1.00 | 0.19 | 1.00 | 0.00 | 0.00 |
| Mole fraction CO2 | 0.9660 | 0.7583 | 0.7583 | 0.1791 | 0.8976 | 0.8976 |
| Mole fraction N2 | 0.0300 | 0.2095 | 0.2095 | 0.6988 | 0.0917 | 0.0917 |
| Mole fraction CH4 | 0.0034 | 0.0139 | 0.0139 | 0.0326 | 0.0093 | 0.0093 |
| Mole fraction He | 0.0000 | 0.0184 | 0.0184 | 0.0895 | 0.0013 | 0.0013 |
| Water content (ppmv) | 601 | 20 | 20 | 0 | 24 | 24 |
| K1 (kW) | −759 | | | | | |
| K2 (kW) | 2809 | | | | | |
| P1 (kW) | 528 | | | | | |
| P2 (kW) | 1541 | | | | | |
| Total power (kW) | 4120 | | | | | |

In an alternative to Example 1, about 30% of condensed stream 70 is fed to the top of the distillation column C1 as liquid wash stream 71. This provides a wash section at the top of the column between the stage where liquid wash stream 71 enters the column and the stage where distillation column feed stream 15 enters the column. The wash section reduces the water content of the lights-enriched vapor stream 55 and allows a colder condenser temperature of −50 C compared to −26 C in Example 1. The lower water content in lights-enriched vapor stream 55 changes the constraint on the lowest temperature from water condensing or freezing to carbon dioxide freezing. The lower temperature condenses more carbon dioxide, thus providing a higher concentration of helium in crude lights stream 65. The cost for this higher helium fraction compared to Example 1 is a higher overall power consumption by about 34% due to the colder condenser temperature. Overall helium recovery is 99.9% as in Example 1.

While the principles of the invention have been described above in connection with preferred embodiments, it is to be clearly understood that this description is made only by way of example and not as a limitation of the scope of the invention.

We claim:

1. A process for recovering a light gas from a feed stream comprising carbon dioxide and at least one light gas selected from the group consisting of helium, methane, nitrogen, argon, and oxygen, said process comprising:

cooling said feed stream to form a distillation column feed stream;

separating said distillation column feed stream in a distillation column system to produce a lights-enriched vapor and a lights-depleted bottoms liquid;

pumping said lights-depleted bottoms liquid to produce a pumped lights-depleted stream;

heating said pumped lights-depleted stream without vaporizing to produce a warmed lights-depleted stream;

cooling and at least partially condensing the lights-enriched vapor stream;

separating the cooled lights-enriched stream in a condenser separator to produce a crude lights stream and a condensed stream;

feeding said condensed stream to said distillation column system;

warming the crude lights stream by indirect heat exchange with a recycle stream, producing a warmed crude lights stream and a cooled recycle stream;

and feeding said cooled recycle stream to said distillation column system.

2. The process of claim 1 wherein at least a portion of said condensed stream enters the distillation column at a higher stage than the stage at which the distillation column feed stream enters the distillation column.

3. The process of claim 1 wherein the feed stream is in the liquid phase and below the critical pressure of the feed stream.

4. The process of claim 1 wherein the feed stream is above the critical pressure of the feed stream.

5. The process of claim 1 further comprising the step of pumping said warmed lights-depleted stream to produce a lights-depleted return stream.

6. The process of claim 5 wherein the feed stream comprises a condensable compound selected from the group consisting of water, mercury, and heavy hydrocarbons.

7. The process of claim 6 wherein the lowest minimum solubility safety factor for condensable compounds among the lights-depleted bottoms liquid, the pumped lights-depleted stream, the section of the main heat exchanger in which the pumped lights-depleted stream is heated to form the warmed lights-depleted stream, the warmed lights-depleted stream, and the lights-depleted return stream is greater than the lowest minimum solubility safety factor for condensable compounds among the distillation column feed stream, the lights-enriched vapor, the cooled lights-enriched stream, and the distillation column system.

8. The process of claim 1 wherein the feed stream is expanded after cooling and prior to separation in said distillation column system.

9. An apparatus for carrying out the process of claim 1, said apparatus comprising:

said distillation column system for separating said distillation column feed stream to produce said lights-enriched vapor and said lights-depleted bottoms liquid;

a pumping system in fluid flow communication with said distillation column system for pumping said lights-depleted bottoms liquid to produce said pumped lights-depleted stream;

a first heat exchanger system in fluid flow communication with said distillation column system and said pumping system for cooling said feed stream to produce said distillation column feed stream by indirect heat exchange against said pumped lights-depleted stream without vaporizing to produce said warmed lights-depleted stream;

a second heat exchanger system in fluid flow communication with said distillation column system for the cooling and at least partial condensation of said lights-enriched vapor;

the condenser separator in fluid flow communication with said second heat exchanger system and said distillation column system for the separation of said cooled lights-enriched stream to produce the crude lights stream and the condensed stream;

a purification system for separating said crude lights stream to produce a pure lights product and the recycle stream;

and a third heat exchanger system in fluid flow communication with said condenser separator and said purification system for the heating of said crude lights stream by indirect heat exchange against said recycle stream.

* * * * *